US006845590B1

(12) United States Patent
Mills, Jr.

(10) Patent No.: US 6,845,590 B1
(45) Date of Patent: Jan. 25, 2005

(54) FASCIA SYSTEMS FOR ROOF EDGES

(75) Inventor: Roy Franklin Mills, Jr., Sanford, NC (US)

(73) Assignee: Southern Aluminum Finishing Company, Inc., Atlanta, GA (US)

( * ) Notice: Subject to any disclaimer, the term of this patent is extended or adjusted under 35 U.S.C. 154(b) by 0 days.

(21) Appl. No.: 10/418,970

(22) Filed: Apr. 18, 2003

Related U.S. Application Data

(60) Provisional application No. 60/379,725, filed on May 10, 2002.

(51) Int. Cl.[7] ..... E04D 13/15

(52) U.S. Cl. ..... 52/60; 52/94; 52/96; 52/97

(58) Field of Search ..... 52/60, 94, 96, 52/97, 300

(56) References Cited

U.S. PATENT DOCUMENTS

| | | | | | |
|---|---|---|---|---|---|
| 3,624,973 | A | * | 12/1971 | Attaway | 52/60 |
| 3,738,068 | A | * | 6/1973 | Attaway | 52/60 |
| 3,862,531 | A | * | 1/1975 | Attaway et al. | 52/300 |
| 4,404,777 | A | * | 9/1983 | Lolley et al. | 52/60 |
| 4,419,850 | A | | 12/1983 | Butzen | 52/60 |
| 4,439,956 | A | * | 4/1984 | House | 52/60 |
| 4,483,112 | A | * | 11/1984 | Rueblinger | 52/94 |
| 4,641,476 | A | * | 2/1987 | Webb et al. | 52/60 |
| 4,662,129 | A | * | 5/1987 | Hickman | 52/96 |
| 4,665,667 | A | * | 5/1987 | Taylor et al. | 52/96 |
| 4,709,518 | A | | 12/1987 | Lane | 52/94 |
| 4,780,997 | A | | 11/1988 | Taylor et al. | 52/96 |
| 4,800,689 | A | | 1/1989 | Lane | 52/60 |
| 4,858,406 | A | * | 8/1989 | Lane et al. | 52/300 |
| 5,239,791 | A | | 8/1993 | Mills, Jr. et al. | 52/58 |
| 5,608,993 | A | | 3/1997 | Argiropoulos | 52/96 |
| 5,927,023 | A | | 7/1999 | Kittilstad | 52/60 |
| 6,212,829 | B1 | | 4/2001 | Webb et al. | 52/96 |
| 6,578,322 | B2 | * | 6/2003 | Kintop | 52/96 |

FOREIGN PATENT DOCUMENTS

GB 2 200 669 A * 8/1988 ..... E04D/135/15

OTHER PUBLICATIONS

A New Alcoa Aluminum, 2 pages dated Dec. 1957 found in 52/94 shoes.*

* cited by examiner

*Primary Examiner*—Robert Canfield
(74) *Attorney, Agent, or Firm*—Dean W. Russell; Geoffrey K. Gavin; Kilpatrick Stockton LLP

(57) ABSTRACT

Fascia systems designed to fit over roof edges of buildings, including roof edges with membranes turning down ninety degrees over the vertical portion of the roof edge and built-up roofs, are disclosed. A fascia system includes a rigid base plate, a decorative cover plate, and at least one spring clip. The base plate is secured to a vertical portion of a roof edge with a screw or set of screws. The cover plate fits over the base plate, and the spring clips are situated between an upper portion of the base plate and the underneath side of an upper portion of the cover plate. A portion of an angular protrusion of the base plate extends along a horizontal portion of the roof edge.

20 Claims, 2 Drawing Sheets

FASCIA SYSTEMS FOR ROOF EDGES

This application claims the benefit of U.S. Provisional Patent Application No. 60/379,725, filed May 10, 2002, entitled "Fascia Systems for Roof Edges," the entire contents of which are hereby incorporated by reference.

FIELD OF THE INVENTION

This invention relates to building and roofing materials and more particularly to fascia systems for use with edges of building roofs.

BACKGROUND OF THE INVENTION

Roof membranes are commonly used for covering a roof, including flat roofs and built up roofs. The membrane is laid over the surface of the roof and secured in place by adhesive or mechanical fastening means. In some applications, the roof membrane may be subjected to large wind forces causing the membrane to tend to pull away from the surface of the roof. The edge of the roof is especially susceptible to damage from wind shear forces, and, if the edge of a roof membrane becomes detached from the roof, all or a substantial portion of the membrane may be blown off. For this reason, it is necessary to provide a means for rigidly securing the edge of a roof membrane in place to prevent the edge of the membrane from pulling away from the edge of the roof.

Generally, fascia systems provide a means to secure a roof membrane to a roof edge of a building. Fascia systems are designed to provide protection against wind uplift and to accomplish a waterproof termination, in addition to having a use life of twenty years or more. Fascia systems typically offer finished surfaces to compliment the building exterior and are usually designed to accommodate a particular type of roof membrane.

There are numerous roof membranes used in the roofing industry, including, but not limited to, coal-tar, bituminous, plastic, rubber, and hybrid (e.g., a combination of any of the aforementioned materials) products. Typically, roof membranes are used with one of the following types of roofs: (1) single-ply or elastomeric roofs, (2) built-up or asphalt roofs, or (3) modified bitumen roofs. Existing fascia systems generally accommodate or specialize within one category of roof material and their designs do not allow the use of installer-made metals, such as drip edges, gravel stops, or raised cant edges, which are commonly used in roofing applications.

Accordingly, there is a need for a fascia system that is sturdy, provides the proper protection against wind and water, and is designed such that the fascia system may be used with multiple types of roofs, roof membranes, and installer-made metals.

SUMMARY OF THE INVENTION

The present invention provides improved fascia systems for terminating the periphery of a waterproofing roof membrane at the edge of the building roof. Certain exemplary embodiments of this invention accomplish the design goals of the fascia systems mentioned herein and accommodate numerous types of roof membranes. Additionally, certain exemplary embodiments of fascia systems according to this invention allow for the use of installer-fabricated metals, which significantly extends the application of such embodiments for hybrid roofs.

Certain exemplary embodiments according to the present invention provide an assembly of components designed to fit over roof edges of buildings, including roof edges with membranes turning down ninety degrees over the vertical portion of the roof edge as well as built-up roofs. In an exemplary embodiment, a fascia system according to this invention includes a rigid base plate, a decorative cover plate, and at least one spring clip. The base plate is secured to a vertical portion of a roof edge with a screw or set of screws. The cover plate fits over the base plate, and spring clips are situated between an upper horizontal portion of the base plate and the underneath side of the upper portion of the cover plate. A portion of an angular protrusion of the base plate extends along a horizontal portion of the roof edge.

An exemplary embodiment according to this invention provides a fascia system for securing a membrane to a roof including a base plate secured to the roof, a cover plate engaging the base plate, and at least one spring clip disposed between the base plate and the cover plate. The base plate includes a generally vertical planar portion that extends along a portion of a vertical surface of the roof, a lower edge extending from a bottom end of the generally vertical planar portion of the base plate, an upper portion that extends generally horizontally in each direction away from a top end of the generally vertical planar portion of the base plate, the upper portion including two legs extending therefrom forming a seating area to accept spring clips, and an angular protrusion extending downwardly and inwardly from the generally vertical planar portion of the base plate, the angular protrusion including a flange that extends along a portion of a horizontal surface of the roof.

A cover plate according to an exemplary embodiment includes an outer generally vertical planar portion from which a lower edge extends, the lower edge of the cover plate being designed to snap over and engage the lower edge of the base plate, an upper portion extending inward from a top end of the outer generally vertical planar portion of the cover plate, and an inner generally vertical planar portion extending downward from an end of the upper portion of the cover plate opposite where the upper portion and the outer generally vertical planar portion of the cover plate meet. The at least one spring clip of the fascia system is disposed in the seating area of the base plate. Upon compression of the at least one spring clip by application of pressure to the upper portion of the cover plate, the lower edge of the cover plate snaps over and engages the lower edge of the base plate and the bias of the at least one spring clip causes the cover plate to firmly engage the base plate.

A base plate of a fascia system according to this invention may also include a generally horizontal protrusion extending outward away from the roof, the generally horizontal protrusion located near the approximate elevation of the horizontal surface of the roof, and openings to accommodate fasteners that extend through the openings and secure the generally vertical planar portion of the base plate to the vertical surface of the roof. In an exemplary embodiment, the flange of the angular protrusion of the base plate compresses the roof membrane along the horizontal surface of the roof.

The cover plate and the base plate may be further engaged at contact points between the generally horizontal protrusion of the base plate and the outer generally vertical planar portion of the cover plate and the two legs of the base plate and adjacent surfaces of the inner and outer generally vertical planar portions of the cover plate. A base plate may be manufactured by heating an aluminum billet to a semi-fluid state and pressing the molten mass through a die that is cut to the plate's shape or formed from at least three sheet metal components spot welded or riveted together. A cover plate may be formed from bent aluminum sheet metal and have outer surfaces with a decorative finish. Spring clips may be loose set in the seating area or chemically or mechanically attached to the base plate or the cover plate. Spring clips may be formed from bent stainless steel sheet metal.

DETAILED DESCRIPTION OF THE INVENTION

Certain exemplary embodiments according to the present invention provide an assembly of components designed to fit over roof edges of buildings, including roof edges with membranes turning down ninety degrees over the vertical portion of the roof edge as well as built-up roofs. In an exemplary embodiment, a fascia system according to this invention includes a rigid base plate, a decorative cover plate, and at least one spring clip. The cover plate and the base plate may be cut into ten foot sections or lengths, and the spring clips field installed at thirty inch centers. The base plate is secured to a vertical portion of a roof edge with a screw or set of screws. The cover plate fits over the base plate, and the spring clips are situated between an upper horizontal portion of the base plate and the underneath side of the upper portion of the cover plate. A portion of an angular protrusion of the base plate extends along a horizontal portion of the roof edge.

Certain fascia systems according to the present invention may be used to secure a membrane to a roof. To do this, a drip edge may be used against the roof's surface and beneath the rubber membrane. The drip edge has a raised angular lip whereby the rubber membrane forms fittingly over the drip edge and is further compressed onto the drip edge by the base plate of the fascia system. The drip edge's raised lip prevents leakage, and thus sealants are unnecessary for use with the fascia system. Alternatively, fascia systems according to this invention may be used without also using a drip edge, and the use of sealants is optional in such instances.

Figure 1:
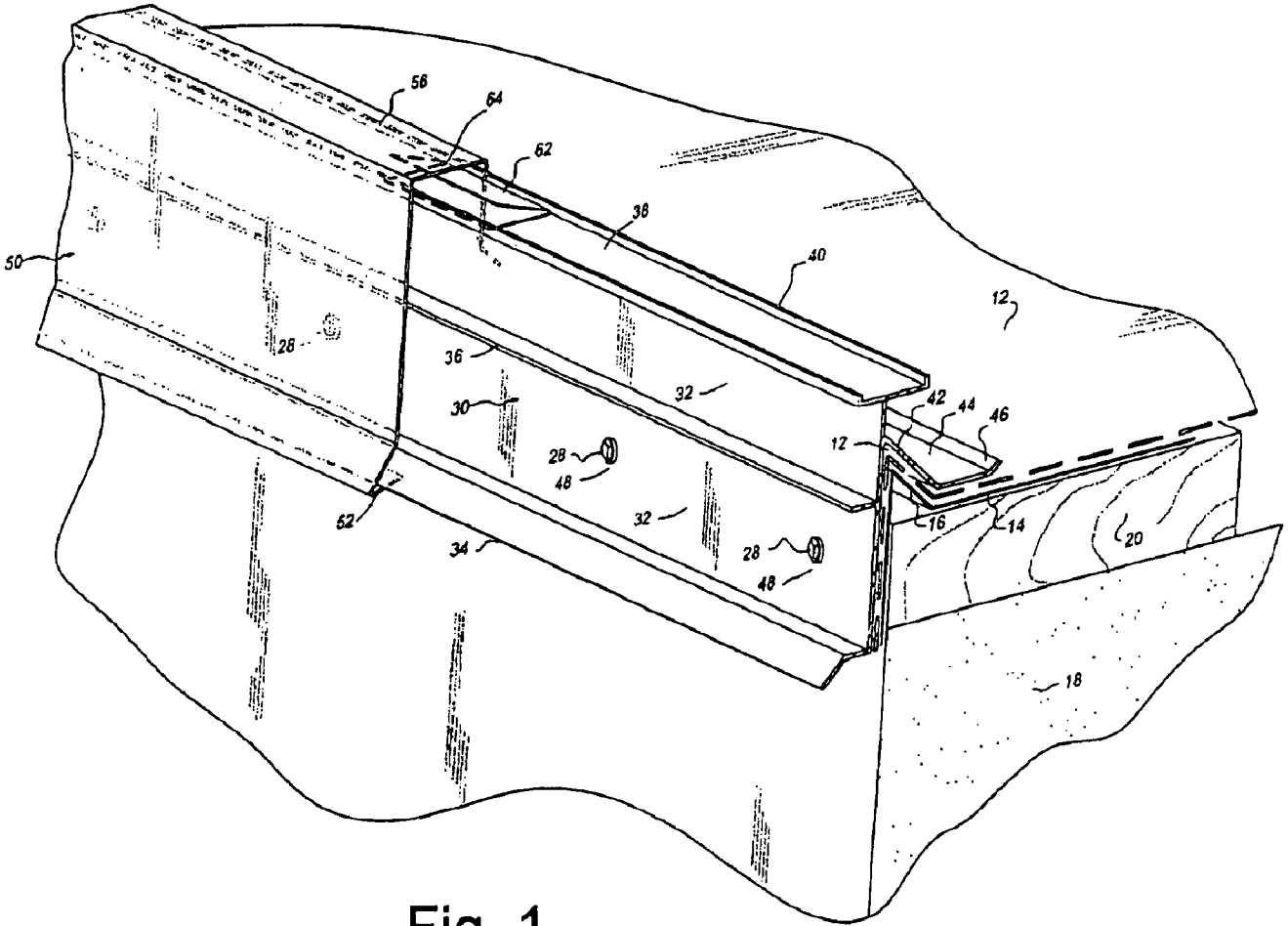
FIG. 1 is a perspective view of an exemplary embodiment of a fascia system according to the present invention installed on a roof edge.
Figure 2:
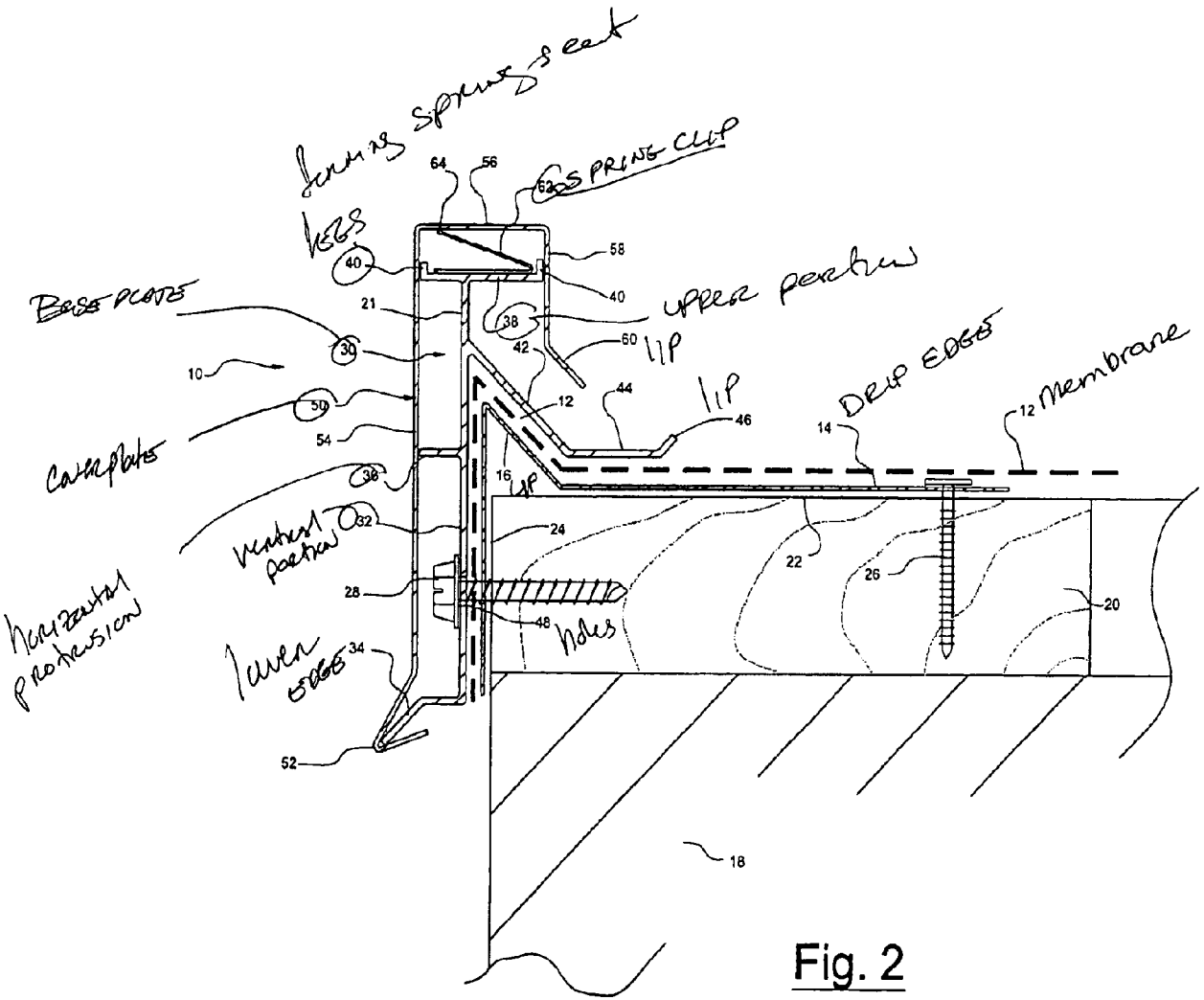
FIG. 2 is a side sectional view of the embodiment of FIG. 1.

Referring now to FIGS. 1 and 2, a fascia system 10 includes a rigid base plate 30, a fascia cover plate 50, and one or more spring tension clips 62. In the exemplary embodiment shown in FIGS. 1 and 2, fascia system 10 fits over a roof membrane 12 and a roofers' metal edge or drip edge 14. Along a horizontal surface 22 of a roof edge 18, roofing nails 26 are driven into wood plates 20 of the building to secure drip edge 14 to the roof. Drip edge 14 is not required but may be used at the discretion of an installer, such use typically depending on the type of roofing material used. Drip edge 14 has a raised angular lip 16 whereby roof membrane 12 forms fittingly over drip edge 14. Angular lip 16 helps prevents leakage, and sealants are generally unnecessary for use with drip edges.

Base plate 30 is configured to assemble with spring clips 62 and cover plate 50, as shown in FIGS. 1 and 2. In an exemplary embodiment, base plate 30 is an aluminum extrusion with multi-plane surfaces. As shown in FIG. 2, base plate 30 includes a generally vertical planar portion 32. Extending outward from vertical planar portion 32 is a generally horizontal protrusion 36. Horizontal protrusion 36 is located near or at the approximate elevation of horizontal roof surface 22 to provide support and rigidity to fascia system 10.

Extending from the lower part of vertical planar portion 32 is a lower edge 34 that is designed to engage cover plate 50, as shown in FIG. 2. As shown in FIG. 2, lower edge 34 extends outward from vertical planar portion 32 at an angle of approximately ninety degrees and then extends downward at an angle of approximately one hundred thirty-five degrees relative to vertical planar portion 32. At the top of base plate 30, an upper portion 38 interfaces with vertical planar portion 32, forming a "T" intersection, as shown in FIG. 2. Upper portion 38 includes two legs 40. Legs 40 may contact cover plate 50, as shown in FIG. 2. Upper portion 38, including legs 40, forms a seating area to accept spring clips 62.

Protruding downwardly and inwardly from vertical planar portion 32 is an angular protrusion 42. In the exemplary embodiment shown in FIG. 2, angular protrusion extends from vertical planar portion at an interior angle of approximately forty-five degrees. Angular protrusion 42 includes a flange 44 and a lip 46. Holes 48 are provided in vertical planar portion 32 of base plate 30 to accommodate fasteners 28. Fasteners 28 extend through holes 48 and into wood plates 20, securing vertical planar portion 32 of base plate 30 to a vertical surface 24 of roof edge 18.

Spring tension clips 62 are configured to assemble with base plate 30 and cover plate 50, as shown in FIGS. 1 and 2. In an exemplary embodiment, spring clips 62 are fabricated sheet metal parts manufactured from stainless steel sheet. Spring clips 62 may be manufactured by cutting stainless steel sheet, or other metals with spring characteristics, into small blanks and mechanically bending them with a sheet metal press to form angular shapes with an opening of approximately forty-five degrees.

Cover plate 50 is configured to assemble with base plate 30 and spring clips 62, as shown in FIGS. 1 and 2. In an exemplary embodiment, cover plate 50 is a fabricated sheet metal part, preferably aluminum sheet. Cover plate 50 may be manufactured by cutting aluminum sheet into strips and mechanically bending the strips with a sheet metal press to form angular shapes. As shown in FIGS. 1 and 2, cover plate 50 includes an outer generally vertical planar portion 54. Extending from outer vertical planar portion 54 is a lower edge 52. As shown in FIG. 2, lower edge 52 includes a portion bent outward approximately forty-five degrees from outer vertical planar portion 54 and a portion bent back to the interior approximately one hundred fifty degrees to form a hemmed edge.

Extending inward from outer vertical planar portion 54 at an angle of approximately ninety degrees is an upper portion 56 of cover plate 50. An inner generally vertical planar portion 58 extends downward from upper portion 56 at an angle of approximately ninety degrees, as shown in FIG. 2, and ends in a lip 60 that extends away from inner vertical planar portion 58 at approximately forty-five degrees. The exterior or outward-facing surfaces of each portion, edge, or lip of cover plate 50 are exposed to view and may receive finishing, such as color coatings.

In the exemplary embodiment shown in FIGS. 1 and 2, fascia system 10 is used with a single-ply, elastomeric roof membrane 12. Roof membrane 12 extends over drip edge 14, which is secured to wood plates 20 of horizontal surface 22 of roof edge 18. As shown in FIG. 2, drip edge 14 includes a generally horizontal planar portion, a generally vertical planar portion, and angular lip 16.

Base plate 30 is installed over drip edge 14, as shown in FIGS. 1 and 2. Base plate 30 is pressed firmly in place to cause compression between drip edge 14, including angular lip 16, and angular protrusion 42 of base plate 30, thereby compressing roof membrane 12. Compression also occurs between vertical planar portion 32 of base plate 30 and the vertical planar portion of drip edge 14. Compression is maintained by fastening base plate 30 to vertical surface 24 of roof edge 18 with fasteners 28, as shown in FIGS. 1 and 2. Fasteners 28 extend through one or more holes or openings 48 in base plate 30, as well as corresponding openings in roof membrane 12 and drip edge 14, and into wood plates 20.

The compression action of base plate 30 against drip edge 14 and wood plates 20 securely retains roof membrane 12 and prevents roof membrane 12 from pulling away from the edge of the building. Additionally, flange 44 of base plate 30 compresses roof membrane 12 to the horizontal planar portion of drip edge 14, further restraining roof membrane 12 from pulling away from the edge of the building or roof in an upward fashion.

As previously noted, the use of fascia system 10 does not require that drip edge 14 also be used. In such an instance, as base plate 30 is pressed firmly in place, compression is created between base plate 30 and wood plates 20 of roof edge 18 on both horizontal surface 22 and vertical surface 24. The use of fasteners 28 maintains such compression, securing roof membrane 12 to the building roof as desired.

Base plate 30 includes a seating area, formed by upper portion 38, including legs 40, as shown in FIGS. 1 and 2, in which one or more spring clips 62 are placed. Spring clips 62 are placed so that an edge 64 contacts the interior surface of upper portion 56 of cover plate 50, as shown in FIGS. 1 and 2. While certain exemplary embodiments allow spring clips 62 to be loose set in the seating area, spring clips 62 may also be chemically or mechanically attached to base plate 30 or cover plate 50.

Cover plate 50 of fascia system 10 engages or snaps on over base plate 30, as shown in FIGS. 1 and 2. Pressure is manually applied to upper portion 56 of cover plate 50 until compression of spring clips 62 is achieved and lower edge 52 of cover plate 50 snaps over and engages lower edge 34 of base plate 30. When manual pressure is stopped, cover plate 50 firmly engages base plate 30 because of the bias of spring clips 62. This bias creates an upward and inward vector of force against the interior surface of upper portion 56 of cover plate 50 and a downward and inward vector of force on the top surface of upper portion 38 of base plate 30. Tension between spring clips 62 and cover plate 50 is maintained by the engagement of lower edge 52 of cover plate 50 with lower edge 34 of base plate 30. Moreover, cover plate 50 and base plate 30 have additional contact points between horizontal protrusion 36 of base plate 30 and vertical planar portion 54 of cover plate 50, as well as legs 40 of base plate 30 and adjacent surfaces of vertical planar portions 54 and 58 of cover plate 50.

In an exemplary embodiment, base plate 30 and cover plate 50 may be cut into ten feet sections or lengths, and spring clips 62 may be field installed at thirty inch centers. Standard face sizes for cover plate 50 may be four and one-half, six, and eight inches. In certain exemplary embodiments, base plate 30 may be manufactured by heating an aluminum billet to a semi-fluid state and pressing the molten mass through a die that is cut to the plate's shape. Base plate 30 may be extruded in long lengths, cut, and punched to the desired specifications. Alternatively, base plate 30 may be formed from at least three sheet metal components spot welded or riveted together.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope.

What is claimed is:

1. A fascia system for securing a membrane to a roof, the fascia system comprising:

a base plate secured to the roof, the base plate comprising:

a generally vertical planar portion that extends along a portion of a vertical surface of the roof;

a lower edge extending from a bottom end of the generally vertical planar portion of the base plate;

an upper portion that extends generally horizontally in each direction away from a top end of the generally vertical planar portion of the base plate, the upper portion including two legs extending therefrom and forming a seating area to accept spring clips;

an angular protrusion extending downwardly and inwardly from the generally vertical planar portion of the base plate, the angular protrusion including a flange that extends, along a portion of a horizontal surface of the roof;

a cover plate engaging the base plate, the cover plate comprising:

an outer generally vertical planar portion from which a lower edge extends, the lower edge of the cover plate being designed to snap over and engage the lower edge of the base plate;

an upper portion extending inward from a top end of the outer generally vertical planar portion of the cover plate;

an inner generally vertical planar portion extending downward from an end of the upper portion of the cover plate opposite where the upper portion and the outer generally vertical planar portion of the cover plate meet; and at least one spring clip disposed in the seating area of the base plate, wherein, upon compression of the at least one spring clip by application of pressure to the upper portion of the cover plate, the lower edge of the cover plate snaps over and engages the lower edge of the base plate and the bias of the at least one spring clip causes the cover plate to firmly engage the base plate after the pressure is released.

2. The fascia system of claim 1, wherein the base plate further comprises:

a generally horizontal protrusion extending outward away from the roof, the generally horizontal protrusion located near the approximate elevation of the horizontal surface of the roof.

3. The fascia system of claim 2, wherein the cover plate and the base plate have additional contact points between:

the generally horizontal protrusion of the base plate and the outer generally vertical planar portion of the cover plate; and the two legs of the base plate and adjacent surfaces of the inner and outer generally vertical planar portions of the cover plate.

4. The fascia system of claim 1, wherein the angular protrusion of the base plate includes a lip that extends upward from the flange.

5. The fascia system of claim 1, wherein the base plate includes openings to accommodate fasteners that extend through the openings and secure the generally vertical planar portion of the base plate to the vertical surface of the roof.

6. The fascia system of claim 1, wherein the flange of the angular protrusion of the base plate compresses the roof membrane along the horizontal surface of the roof.

7. The fascia system of claim 1, wherein the base plate is manufactured by heating an aluminum billet to a semi-fluid state and pressing the molten mass through a die that is cut to the plate's shape.

8. The fascia system of claim 1, wherein the base plate is formed from at least three sheet metal components spot welded or riveted together.

9. The fascia system of claim 1, wherein the cover plate is formed from bent aluminum sheet metal.

10. The fascia system of claim 1, wherein outer surfaces of the cover plate have a decorative finish.

11. The fascia system of claim 1, wherein the cover plate has a face size of approximately four and one-half, six, or eight inches.

12. The fascia system of claim 1, wherein the base plate and the cover plate are cut into ten foot sections.

13. The fascia system of claim 1, wherein the at least one spring clip is loose set in the seating area.

14. The fascia system of claim 1, wherein the at least one spring clip is chemically or mechanically attached to the base plate or the cover plate.

15. The fascia system of claim 1, wherein the at least one spring clip is formed from bent stainless steel sheet metal.

16. A system for protecting a roof from water comprising:

the fascia system of claim 1;

a roof membrane; and a drip edge used beneath the roof membrane.

17. The system of claim 16, wherein intersection of the angular protrusion and the generally vertical planar portion of the base plate form an area within which a raised angular lip of the drip edge may fit.

18. A fascia system for securing a membrane to a roof, the fascia system comprising:

a base plate secured to the roof, the base plate comprising:

a generally vertical planar portion that extends along a portion of a vertical surface of the roof;

a lower edge extending from a bottom end of the generally vertical planar portion of the base plate;

a generally horizontal protrusion extending outward away from the roof, the generally horizontal protrusion located near the approximate elevation of a horizontal surface of the roof;

an upper portion that extends generally horizontally in each direction away from a top end of the generally vertical planar portion of the base plate, the upper portion including two legs extending therefrom and forming a seating area to accept spring clips;

an angular protrusion extending downwardly and inwardly from the generally vertical planar portion of the base plate, the angular protrusion including a flange that extends along a portion of the horizontal surface of the roof and compresses the roof membrane along the horizontal surface of the roof;

openings to accommodate fasteners that extend through the openings and secure the generally vertical planar portion of the base plate to the vertical surface of the roof;

a cover plate engaging the base plate, the-cover plate comprising:

an outer generally vertical planar portion from which a lower edge extends, the lower edge of the cover plate being designed to snap over and engage the lower edge of the base plate;

an upper portion extending inward from a top end of the outer generally vertical planar portion of the cover plate;

an inner generally vertical planar portion extending downward from an end of the upper portion of the cover plate opposite where the upper portion and the outer generally vertical planar portion of the cover plate meet; and at least one spring clip disposed in the seating area of the base plate, wherein, upon compression of the at least one spring clip by application of pressure to the upper portion of the cover plate, the lower edge of the cover plate snaps over and engages the lower edge of the base plate and the bias of the at least one spring clip causes the cover plate to firmly engage the base plate after the pressure is released.

19. The fascia system of claim 18, wherein the cover plate and the base plate have additional contact points between:

the generally horizontal protrusion of the base plate and the outer generally vertical planar portion of the cover plate; and the two legs of the base plate and adjacent surfaces of the inner and outer generally vertical planar portions of the cover plate.

20. The fascia system of claim 18, wherein:

the base plate is manufactured by heating an aluminum billet to a semi-fluid state and pressing the molten mass through a die that is cut to the plate's shape;

the cover plate is formed from bent aluminum sheet metal and outer surfaces of the cover plate have a decorative finish; and the at least one spring clip is formed from bent stainless steel sheet metal and loose set in the seating area.

* * * * *